US009469993B2

(12) United States Patent
Bauermeister et al.

(10) Patent No.: US 9,469,993 B2
(45) Date of Patent: Oct. 18, 2016

(54) POINT-SUPPORTED ELEMENT OR FLAT CONCRETE CEILING

(71) Applicant: FILIGRAN TRAGERSYSTEME GMBH & CO. KG, Leese/Weser (DE)

(72) Inventors: Ulrich Bauermeister, Nienburg (DE); Johannes Furche, Nienburg (DE)

(73) Assignee: Filigran Tragersysteme GMBH & Co. KG, Leese/Weser (DE)

( * ) Notice: Subject to any disclaimer, the term of this patent is extended or adjusted under 35 U.S.C. 154(b) by 0 days.

(21) Appl. No.: 14/420,891

(22) PCT Filed: Jun. 18, 2013

(86) PCT No.: PCT/EP2013/062555

§ 371 (c)(1),
(2) Date: Feb. 10, 2015

(87) PCT Pub. No.: WO2014/026781

PCT Pub. Date: Feb. 20, 2014

(65) Prior Publication Data

US 2015/0204074 A1 Jul. 23, 2015

(30) Foreign Application Priority Data

Aug. 13, 2012 (EP) ..... 12005851

(51) Int. Cl.
*E04C 3/293* (2006.01)
*E04C 5/06* (2006.01)
(Continued)

(52) U.S. Cl.
CPC ..... *E04C 3/293* (2013.01); *E04C 3/20* (2013.01); *E04C 3/294* (2013.01); *E04C 5/06* (2013.01);
(Continued)

(58) Field of Classification Search
CPC ..... E04B 2103/02; E04C 3/20; E04C 3/293; E04C 3/294; E04C 5/00; E04C 5/06; E04C 5/0645; E04C 5/065; E04C 5/0653
USPC ..... 52/649.1, 690
See application file for complete search history.

(56) References Cited

U.S. PATENT DOCUMENTS 1,335,886 A * 4/1920 Evers ..... 52/259
1,748,423 A * 2/1930 Macomber ..... 29/897.31
(Continued)

FOREIGN PATENT DOCUMENTS

DE 2026425 A1 * 12/1971
DE 3414410 A1 * 10/1984 ..... B21F 27/20
(Continued)

OTHER PUBLICATIONS es@cemet: EPO machine translation EP 2050887 A2 Bauermeister, english only; es@cemet: EPO machine translation EP 2050887 A2 Bauermeister, english and originial.*
(Continued)

*Primary Examiner* — Charles A Fox
*Assistant Examiner* — Joseph J Sadlon
(74) *Attorney, Agent, or Firm* — Fattibene and Fattibene LL; Paul A. Fattibene

(57) ABSTRACT

The invention relates to a point-supported element or flat concrete ceiling (BD) that comprises a transverse force and punching reinforcement (B) into which a lattice beam (1) that tapers on a support vertical axis (A) is integrated, wherein the lattice beam comprises lower chords (U) and a continuous upper chord (O) or anchoring elements (10) arranged with open spaces (Z) between one another and at least one serpentine diagonal strut section (D) with upper and lower bent portions (11, 12) between each two successive diagonal struts (S1, S2), said bent portions being secured in securing points (SO, SU). The diagonal struts (S1, S2) are angled in the same manner upwards and in the direction of the support (T). The diagonal strut (S1) nearest to the support is inclined at a steeper angle ($\alpha$)<90° relative to the lower chords (U), and the preceding diagonal strut (S2) further from the support is inclined at an angle, which is flatter by at least 10°, of 45°≤($\alpha$2)<90° such that, of the concrete anchoring zones (VO, VU) formed by the diagonal strut (S1) nearest to the support, the upper concrete anchoring zone (VO) lies closer to the support vertical axis (A) than the lower concrete anchoring zone (VU).

12 Claims, 3 Drawing Sheets

(51) Int. Cl.
*E04C 3/20* (2006.01)
*E04C 3/294* (2006.01)
*E04C 5/065* (2006.01)

(52) U.S. Cl.
CPC ..... *E04C 5/065* (2013.01); *E04C 5/0645* (2013.01); *E04C 5/0653* (2013.01); *E04B 2103/02* (2013.01)

(56) References Cited

U.S. PATENT DOCUMENTS

| | | | | | |
|---|---|---|---|---|---|
| 2,420,860 | A * | 5/1947 | Burner | E04C 5/168 | 52/686 |
| 3,305,988 | A * | 2/1967 | Halopoff | 52/291 | |
| 3,400,508 | A * | 9/1968 | Dietner | E04C 5/065 | 52/677 |
| 3,930,349 | A * | 1/1976 | Wellershaus | E04C 5/065 | 52/650.2 |
| 4,494,349 | A * | 1/1985 | Clements | E04B 5/38 | 52/309.12 |
| 4,689,867 | A * | 9/1987 | Tolliver | E04C 5/18 | 140/112 |
| 5,501,055 | A * | 3/1996 | Storch | E04C 2/06 | 264/333 |
| 6,003,281 | A * | 12/1999 | Pilakoutas | E04C 5/0645 | 52/414 |
| 6,006,483 | A | 12/1999 | Lee | 52/414 | |
| 6,056,240 | A * | 5/2000 | Hagenlocher | 244/125 | |
| 7,540,121 | B2 * | 6/2009 | Haeussler | 52/323 | |
| 8,511,935 | B1 * | 8/2013 | Thomas | E01C 11/14 | 404/135 |
| 2008/0028719 | A1 * | 2/2008 | Rutledge | 52/690 | |
| 2010/0170194 | A1 | 7/2010 | Leone | 52/838 | |
| 2012/0137619 | A1 | 6/2012 | Martter | 52/649.1 | |
| 2014/0059967 | A1 * | 3/2014 | Martter | 52/649.1 | |

FOREIGN PATENT DOCUMENTS

| | | | |
|---|---|---|---|
| DE | 201 03 059 | U1 | 6/2001 |
| DE | 10 2007047616 | A1 | 4/2008 |
| EP | 0781891 | A1 * | 7/1997 |
| EP | 1 070 800 | A1 | 7/2000 |
| EP | 2 050 887 | A2 | 4/2009 |
| EP | 2050887 | A2 * | 4/2009 |
| WO | WO 2009/010366 | | 1/2009 |

OTHER PUBLICATIONS

European Patent Office search report dated Jan. 22, 2013 in corresponding EPO Application No. EP 12 00 5851.6.

* cited by examiner

POINT-SUPPORTED ELEMENT OR FLAT CONCRETE CEILING

FIELD OF THE INVENTION

The invention relates to a point-supported element or flat concrete ceiling with transverse force and punching shear reinforcement and at least one lattice beam.

BACKGROUND OF THE INVENTION

In the case of a point supported element or flat concrete ceiling known from EP 1 070 800 B1, in each lattice beam of the transverse force and punching shear reinforcement the upper and/or lower bent portions between the diagonal struts project beyond the continuous upper chord and/or the continuous lower chord, also in order to form efficiently acting concrete anchoring zones in the ceiling. The serpentine diagonal strut sections are bent regularly and in each case have a diagonal strut oriented at 90° to the chords and then a diagonal strut inclined by 45° to the chords, such that, in the end region of a lattice beam extending towards the support, the diagonal strut closest to the support produces upper and lower concrete anchoring zones which are spaced equidistantly from the vertical support axis.

The lattice beams known from EP 2 050 887 B1 for transverse force and punching shear reinforcement of element or flat concrete ceilings lack a continuous upper chord. On the other hand, anchoring elements are provided which are located one behind the other in the longitudinal direction of the lattice beam with free intermediate spacings and to which the upper bent portions of the serpentine diagonal strut sections are secured. In one embodiment (FIG. 2*c*) two adjacent diagonal struts are shown inclined in the same direction and substantially parallel to one another at around 45° relative to the lower chords, such that the upper concrete anchoring zone is offset by a considerable amount in the longitudinal direction of the lattice beam relative to the lower concrete anchoring zone of the same diagonal strut by a very large amount, which corresponds approximately to the lattice beam height.

DE 10 2007 047 616 A1 discloses a lattice beam with two lower chords, a continuous upper chord and two serpentine diagonal strut sections, in which in each case a diagonal strut inclined at 90° relative to the chords follows a diagonal strut inclined at 45°. The concrete anchoring zones formed in the region of the securing points of the diagonal strut inclined at 90° lie above one another without any offset in the lattice beam longitudinal direction.

According to German general building approvals, if lattice beams are used as punching shear reinforcements increase factors result of, for example, 1.25 (Approval Z-15.1-38), 1.6 (Approval Z-15.1-289) and 1.7 (Approval Z-15.1-217) relative to slabs or punching shear reinforcement as a function of lattice beam type. These approvals are based on component testing on portions of ceilings. The increase factors identified are lower than with other known traditional reinforcement systems, such as with double-headed bolts.

Tests with lattice beams as punching shear reinforcement are known from Eligehausen et al. (Beton- and Stahlbetonbau 98 [Concrete and Reinforced Concrete Structures 98], (2003), Issue 6). In these tests steep failure cracks starting from the support edge and pointing away from the support arose in the concrete slab, which the perpendicular bars, close to the support, of the lattice beams intersected only in the upper region or passed through above the lattice beam.

The concrete pressure zone in the region of the lattice beam lower chords was severely damaged thereby. The efficacy of the punching shear reinforcement was greatly limited thereby.

With lattice beams according to EP 2 050 887 B1, better reinforcement efficacy and higher increase factors can be achieved relative to the punching shear of concrete slabs than with lattice beams according to EP 1 070 800 B1. However, in modern built structures the requirements for reinforcement efficacy and achievable increase factors relative to concrete slab punching shear may be even higher, and cannot be met with these known lattice beams.

SUMMERY OF THE INVENTION

The object of the invention is to provide a point-supported element or flat concrete ceiling with even better reinforcement efficacy and higher punching shear increase factors.

The object addressed is achieved with the features of the different embodiments of the invention.

Due to the specific different inclinations, nonetheless in the same direction upwards towards the support vertical axis, in each case of two successive diagonal struts, of which at least the diagonal strut closest to the support extends at a steeper angle <90° relative to the lower chords than the strut further from the support with its angle ≥45° which is at least 10° flatter. Due to the inclinations in the same direction upwards towards the support, at least in the case of the diagonal strut closest to the support an overhang arises of each upper securing point in the lattice beam longitudinal direction beyond the lower securing point which is less than the height of the lattice beam. This combination of features results, inter alia, in the advantage that a crack in the ceiling extending for example from the vertical projection of a support side face into the ceiling is intersected by the serpentine strut section and propagation is prevented. The concrete pressure zone in the region of the lower chords is not damaged. Overall, the novel lattice beam shape and the arrangement of the lattice beam relative to the support results surprisingly in better reinforcement efficacy and higher increase factors relative to punching shear of concrete slabs may be achieved with such lattice beams than hitherto, which has been confirmed by practical tests in comparison with lattice beams for example according to EP 1 070 800 B1 or EP 2 050 887 B1, without the exact reasons for the improvement being known.

This configuration is not only achieved by the specific angles at least of the diagonal strut closest to the support and subsequent diagonal struts, but may optionally be provided by specific cutting off of prefabricated lattice beams at different points in the longitudinal direction, or result from a combination of these structural measures. This applies to lattice beams with at least one continuous upper chord or with anchoring elements located one behind the other and separated by free intermediate spacings, to which the upper bent portions of the serpentine diagonal strut section(s) are secured, e.g. welded.

Particularly good results have been given in the case of cross-sectionally quadrilateral, polygonal or circular supports when the upper concrete anchoring zone ends approximately with the vertical projection of the support side face or is offset slightly therebeyond towards the support vertical axis, while the lower concrete anchoring zone of the same diagonal strut closest to the support remains in front of the vertical projection of the support side face.

Highly promising results have also been obtained when the lower concrete anchoring zone maintains a distance of only around 2.0 cm from the vertical projection of the support side face, and/or the overhang of the upper concrete anchoring zone beyond the lower concrete anchoring zone corresponds at least approximately to the distance of the lower concrete anchoring zone from the vertical projection of the support side face.

The steeper angle of inclination at least of the diagonal strut closest to the support should amount to between approximately 70° and 85° relative to the lower chords, while the flatter angle of inclination at least of the next diagonal strut away from the support should amount to between 45° and 75°. The steeper the angle of the diagonal strut closest to the support, the steeper the angle of the diagonal strut remote from the support may also be, however in any event around 10° flatter than the steeper angle.

The improved reinforcement efficacy and particular high increase factors may furthermore be achieved when the surface of the diagonal strut and/or of the chords is ribbed. This results in even better engagement with the concrete.

It is additionally specifically important, in order to prevent damage in the concrete pressure zone in the case of the lower chords, for the diameter at least of the lower chords to be greater than the diameter of the serpentine diagonal strut section. The diameter of the lower chords should amount to at least 10 mm, wherein the diagonal struts then for example have a diameter of approximately 9 mm.

In an expedient embodiment with a reinforcement in the support, the overhang of the upper concrete anchoring zone beyond the lower concrete anchoring zone of the diagonal strut closest to the support should correspond at least approximately to the distance of the lower concrete anchoring zone from the vertical projection of the support side face plus a size which corresponds at least to a portion of the size of a concrete cover of a reinforcement in the support.

In an expedient embodiment, the element or flat concrete ceiling is made from prefabricated concrete slabs with a concrete top layer, the lattice beam in question being concreted into the concrete slab. In this case, the overhang of the upper concrete anchoring zone of the diagonal strut closest to the support should correspond relatively exactly to the distance of an edge of the concrete slab from the vertical projection of the support side face and/or at most the distance of the edge of the concrete slab from a reinforcement close to the edge in the support.

In an embodiment with joints between the concrete slabs, the overhang should correspond at most to approximately half the width of a joint between two adjacent concrete slabs.

In an embodiment with anchoring elements, these should be prefabricated shaped parts or chord pieces, which project at both ends in the longitudinal direction of the lattice beam beyond the upper bent portions and thus contribute to the creation of the respective upper concrete anchoring zone.

Further expedient embodiments are described.

BRIEF DESCRIPTION OF THE DRAWINGS

The subject matter of the invention is explained below with reference to the drawings, in which.

DETAILED DESCRIPTION OF THE PREFERRED EMBODIMENTS

Figure 1:
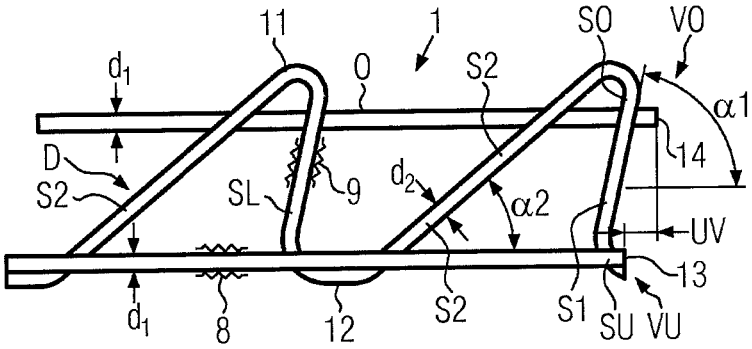
FIG. 1 is a side view of a lattice beam in an end region.
Figure 2:
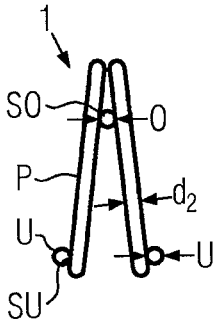
FIG. 2 shows a vertical section through FIG. 1.
Figure 5:
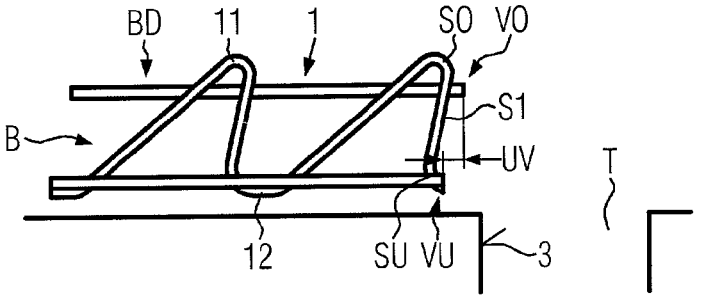
FIG. 5 is a side view of an element or flat concrete ceiling with point support and a transverse force and punching shear reinforcement with at least one lattice beam according to FIGS. 1 and 2.

FIGS. 1 and 2 show a lattice beam 1 in side view and in a vertical section, as may be embedded as part of a transverse force and punching shear reinforcement in an element or flat concrete ceiling BD (FIG. 5). The lattice beam 1 comprises two straight, continuous and parallel lower chords U, two serpentine diagonal strut sections D (alternatively and not shown, just one serpentine diagonal strut section) and a straight, continuous upper chord O. The cross-section of the lattice beam 1 is for example triangular. The serpentine diagonal strut sections D, which may optionally be coincident in side view, are for example secured at the inside bottom to the lower chords U and at the outside top to the upper chord O at upper and lower securing points (weld points) SU, SO. Each serpentine diagonal strut section D is for example bent regularly in such a way that largely similar diagonal struts S1, S2 arise, which are each connected together via upper and lower bent portions 11, 12 and are inclined at different angles in the same direction upwards and towards one end of the lattice beam 1, as shown on the right in FIG. 1. This end region is associated in the concrete ceiling BD (FIG. 5) with a support T of the point support of the ceiling, in such a way that the diagonal struts S1, S2 are inclined in the same direction upwards and towards the support vertical axis A.

At least the diagonal strut S1 closest to the support (assuming that the lattice beam 1 extends with its end region shown towards the support) is inclined towards the support T at an angle $\alpha 1$ relative to the lower and upper chords U, O which is smaller than 90° and amounts to between approximately 70° and 85°. The next diagonal strut S2 away from the support is on the other hand inclined in the same direction upwards towards the support T but at a flatter angle $\alpha 2$ relative to the chords O, U which amounts to between approximately 45° and 75°, however is in each case at least 10° flatter than the steeper angle $\alpha 1$. The upper bent portions 11 between the diagonal struts S1, S2 project upwards significantly beyond the upper chord O, while the lower bent portions 12 either end with the lower chords U or project downwards slightly therebeyond (as shown). "In the same direction" is intended to mean here that the angles $\alpha 1$, $\alpha 2$ are <90° and 45°, but different from one another, i.e. the two diagonal struts S1, S2 are inclined upwards and towards the same lattice beam end.

The surface of the serpentine diagonal strut sections D and/or the chords U, O may additionally comprise a rib structure 9 or 8 respectively, for even better anchoring in the concrete. In the end region, for example an end piece 14 of the upper chord O projects beyond the securing point SO, while the lower chords U are cut off for example just behind the lower securing points SU (or are optionally continued, not shown).

In this way, upper and lower concrete anchoring zones VO, VU are formed either by the bent portions alone or with an anchoring element 10 or anchoring element piece 13' (FIGS. 11 and 12) or a projecting chord piece 14, 13 and the securing points SO, SU (weld points).

Due, inter alia, to the inclinations in the same direction upwards and towards the support T of the diagonal struts S1, S2 and the steeper angle α1 of the diagonal strut S1 closest to the support, in the concrete ceiling BD, in the case of the diagonal strut S1 closest to the support, the upper concrete anchoring zone VO projects in the longitudinal direction of the lattice beam 1 beyond the lower concrete anchoring zone VU in FIG. 1 with an overhang UV. For the diagonal strut S1 closest to the support, for example also the distance between the securing points SO on the upper chord O and SU on the lower chord U amounts to the overhang UV, if (as a theoretical assumption) in each case the securing point SO, SU of the diagonal strut S1 with the respective chord O, U counts as the upper concrete anchoring zone VO and lower concrete anchoring zone VU respectively.

In the lattice beam in FIG. 1, the diagonal strut combination with S1, S2 and α1, α2 repeats in the longitudinal direction of the lattice beam at least once more, preferably regularly over the entire lattice beam length.

The diameters of the chords U, O and the serpentine diagonal strut sections D are labeled d1 and d2. In principle, the diameter d1 should be larger than the diameter d2, wherein preferably the diameter d1 of the lower chords U should amount to at least 10 mm and that of the serpentine diagonal strut section D should amount to approximately 9 mm.

Figure 3:
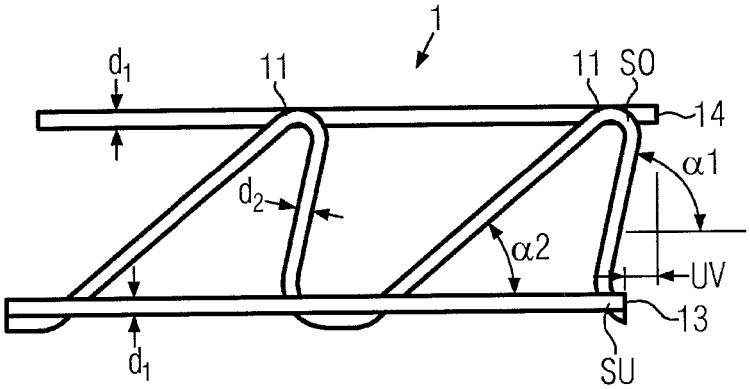
FIG. 3 shows another embodiment of an end portion of a lattice beam.
Figure 4:
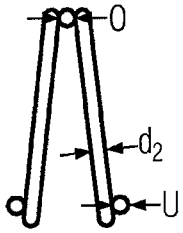
FIG. 4 shows a vertical section through FIG. 3.

In the embodiment of the lattice beam 1 in FIGS. 3 and 4, substantially the same angles α1, α2 are provided for the diagonal struts S1, S2, as explained above. However, the upper bent portions 11 of the serpentine diagonal strut sections D here end substantially flush with the top of the upper chord O.

Figure 6:
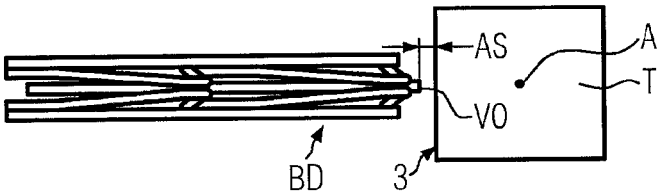
FIG. 6 is a plan view of FIG. 5.
Figure 9:
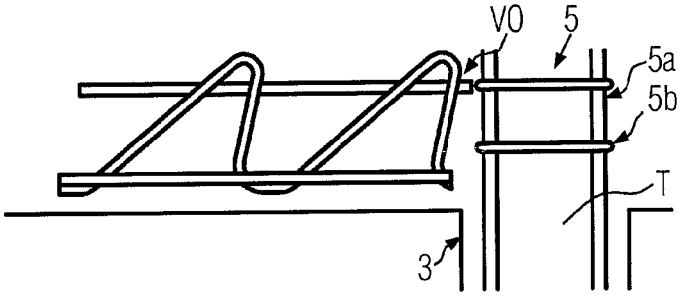
FIG. 9 shows a further embodiment of a concrete ceiling with point support, in side view.
Figure 10:
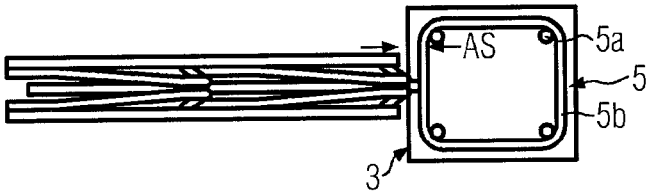
FIG. 10 is a plan view of FIG. 9.

FIGS. 5 and 6 show a lattice beam 1 as part of a transverse force and punching shear reinforcement B of a concrete ceiling BD (element or flat ceiling) with association of the lattice beam 1 with the support T. Although just one lattice beam 1 is shown, a plurality of lattice beams 1 in the concrete ceiling BD may be associated with the support T. In the embodiment shown, the support T has a square cross-section with side faces 3 and a vertical axis A, but could also have a rectangular cross-section or a polygonal cross-section or a circular cross-section and be provided (not shown) with a reinforcement (FIGS. 9 and 10). Similar lattice beams 1 could also be arranged in parallel and be installed to the side of and parallel to another support edge 3 and extend as far as into the region of the support T or therebeyond. In FIG. 6 the lattice beam 1 extends perpendicular to the vertical projection of the support side face 3 and substantially towards the support vertical axis A. The distance AS of the upper concrete anchoring zone VO from the vertical projection of the support side face 3 is less than the distance of the lower concrete anchoring zone VU of the diagonal strut S1 closest to the support from the vertical projection of the support side face 3. In FIG. 6 the clear distance AS is indicated.

Figure 7:
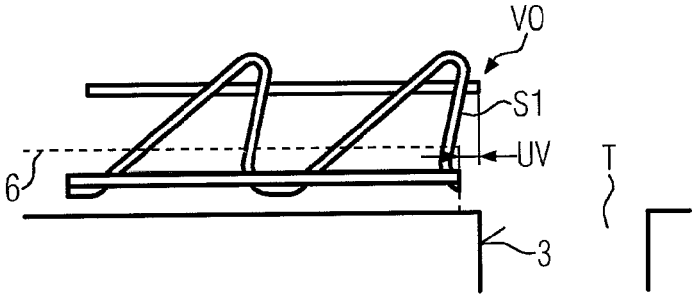
FIG. 7 shows a further embodiment, in side view, of a concrete ceiling with point support.
Figure 8:
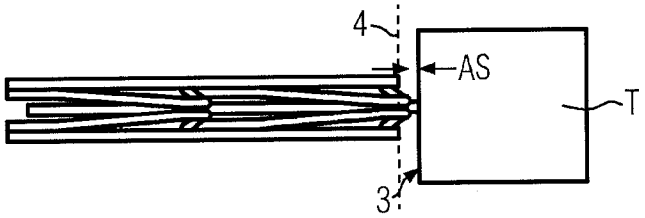
FIG. 8 is a plan view of FIG. 7.

FIGS. 7 and 8 show a preferred embodiment of a concrete ceiling BD. The upper concrete anchoring zone VO here ends relatively exactly with the vertical projection of the support side face 3. The distance AS is thus substantially equal to zero. The distance of the lower concrete anchoring zone VU from the vertical projection of the support side face 3 corresponds to the overhang UV for example of FIGS. 1 and 3.

In FIG. 7 a dashed line 4 indicates the outer edge of a prefabricated concrete slab 6, into which the lattice beam 1 has been concreted, such that the lower concrete anchoring zone VU of the diagonal strut S1 closest to the support lies inside the concrete slab 6. In this case, the overhang UV may correspond to the distance between the edge 4 of the concrete slab 6 and the vertical projection of the support side face 3. The arrangement of the lower concrete anchoring zone VU in FIG. 7 preferably applies for an embodiment of a reinforced concrete ceiling with prefabricated thin reinforced concrete slabs 6, into which the lower part of the punching shear reinforcement B has already been concreted and which are installed at a distance (see the edge 4) from the vertical projection of the side face 3 of the support T. If the concrete slab 6 is placed onto the support T or the entire structure is produced without ready-made concrete slabs, then the lower chord U of the lattice beam 1 may also be continued beyond the lower concrete anchoring zone VU as far as the vertical projection of the support side face 3 or even further to beyond the support T.

FIGS. 9 and 10 show a further embodiment, in which the upper concrete anchoring zone VO of the diagonal strut S1 closest to the support of the lattice beam 1 is above the support T, i.e. inside the vertical projection of the support side face 3. The distance AS of the upper concrete anchoring zone VO from the vertical projection of the support side face 3 is thus negative.

FIGS. 9 and 10 also show a reinforcement 5 for the support T. This reinforcement 5 or the vertical bars 5*a* and/or indicated stirrups 5*b* thereof have a predetermined distance from the support side face 3, i.e, a "concrete overlap" 7. In FIGS. 9 and 10 the upper concrete anchoring zone VO of the diagonal strut S1 closest to the support extends relatively precisely by the size of the concrete overlap 7 beyond the vertical projection of the support side face towards the support vertical axis A and as far as beyond the support T. This illustrated overhang may be a maximum value of a preferred embodiment, i.e. the upper concrete anchoring zone VO should be positioned inside the vertical projection of the concrete overlap 7.

If concrete slabs 6, as is often conventional, are installed with joints between their edges 4, upper concrete anchoring zones VO of the diagonal struts S1 project beyond two opposing concrete slab edges, and these concrete anchoring zones could collide. Therefore in this case the overhang UV should be limited to approximately half the joint width. The joint width often amounts to 4 cm, but other joint widths are also possible. The overhang in the case of a joint width of 4 cm should then amount to approximately 2.0 cm.

In the punching shear reinforcement B, the embodiment of the lattice beam brings about efficient reinforcement of the concrete pressure zone of the concrete slab and thus prevents premature failure. The nominal yield point of the reinforcement components used may preferably amount to 500 $N/mm^2$. Further material properties correspond to those of conventional reinforcing bars. However, reinforcing bars with other, better material properties may also be used. A combination of the novel lattice beam with other reinforcing elements and the same lattice beams with another arrangement with regard to the load introduction surface or support is possible, for example in a case in which further lattice beams are arranged parallel to the support edge or to the vertical projection of the support side face 3.

Figure 11:
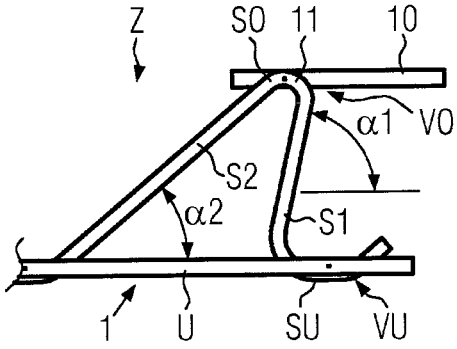
FIG. 11 is a side view of an end portion of a further embodiment of a lattice beam without continuous upper chord, but instead with anchoring elements for the upper bent portions of the serpentine strut sections located one behind the other in the longitudinal direction and separated by free intermediate spacings.
Figure 12:
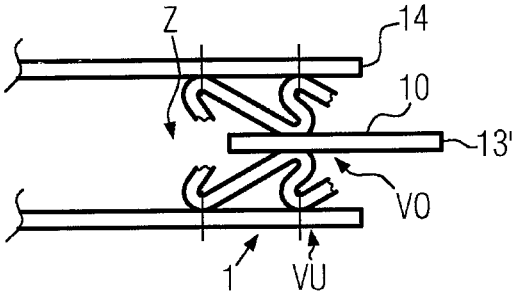
FIG. 12 is a plan view of FIG. 11.

The embodiment of the lattice beam 1 in FIGS. 11 and 12 does not comprise a continuous upper chord, but rather instead of a continuous upper chord anchoring elements 10 located one behind the other in the longitudinal direction with free intermediate spacings Z, which anchoring elements take the form of shaped parts or chord portions and to which the upper bent portions 11 in each case of the two diagonal struts S1, S2 are firmly welded (securing point SU) or fixed in another way, e.g. latched. Each anchoring element 10 projects in the longitudinal direction of the lattice beam 1 beyond the bent portion 11, such that the upper concrete anchoring zone VO, formed in the region for example of the weld point SO, of the diagonal strut S1 closest to the support has the overhang UV relative to the lower concrete anchoring zone VU on each lower chord U. The lattice beam 1 in FIGS. 11 and 12 may be installed like those in the preceding embodiments of the concrete ceiling BD in relation to the support T of the point support.

What is claimed is:

1. Point-supported element or flat concrete ceiling, comprising a transverse force and punching shear reinforcement having incorporated at least one lattice beam running in the longitudinal direction at least approximately to a vertical axis of a support point, supporting the element or flat concrete ceiling, the lattice beam comprising two spaced-apart lower chords and at least one continuous upper chord, and at least one serpentine diagonal strut section with upper and lower bent portions between in each case two successive diagonal struts, said bent portions being secured to the lower and upper chords at securing points, wherein the diagonal struts of each serpentine diagonal strut section in the lattice beam are inclined in different directions upwards and towards the support, and wherein at least in the end region of the at least one lattice beam at the support one diagonal strut closest to the support is inclined at a steeper angle than 90° relative to the lower chords and a preceding diagonal strut remote from the support is inclined at an angle that is at least 10° flatter than the steeper angle when the lattice beam is installed, concreted and is supporting a load, such that, of upper and lower concrete anchoring zones respectively formed in a region of the securing points at least of the diagonal strut that is closest to the support and is inclined at the steeper angle smaller than 90°, the upper concrete anchoring zone being defined by the upper bent portion and the upper chords in the securing point of the diagonal strut that is closest to the support lies closer to the support vertical axis than the lower concrete anchoring zone of the same diagonal strut, the lower concrete anchoring zone being defined by the lower bent portion of the diagonal strut that is closest to the support and a respective lower chord, and wherein the support has a rectangular or square or polygonal cross section, the upper concrete anchoring zone ending at least approximately with a vertical projection of a support side face or is offset beyond this in the direction towards the support vertical axis, and wherein the lower concrete anchoring zone of the same diagonal strut closest to the support is set back from the vertical projection of the support side face.

2. Point-supported element or flat concrete ceiling according to claim 1, wherein an overhang of the upper concrete anchoring zone in the longitudinal direction of the lattice beam beyond the lower concrete anchoring zone of the diagonal strut closest to the support corresponds only at least approximately to the distance of the lower concrete anchoring zone from the vertical projection of the support side face.

3. Point-supported element or flat concrete ceiling according to claim 1, wherein the at least one serpentine diagonal strut is integrated congruently in the lattice beam and is regularly distributed along the length of the lattice beam and is inclined alternately at the steeper and flatter angles.

4. Point-supported element or flat concrete ceiling according to claim 1, wherein the steeper angle is approximately 70° to 85°, and in that the angle that is in each case at least 10° flatter is approximately between 45° and 75°.

5. Point-supported element or flat concrete ceiling according to claim 1, wherein a diameter of the chords is greater than a diameter of the serpentine diagonal strut section.

6. Point-supported element or flat concrete ceiling according to claim 1, wherein a reinforcement is provided in the support, the reinforcement being covered by a concrete cover defining the support side face, and wherein the overhang of the upper concrete anchoring zone in the longitudinal direction of the lattice beam beyond the lower concrete anchoring zone corresponds at least approximately to the distance of the lower concrete anchoring zone from a vertical projection of the support side face plus at least a portion of the size of the concrete cover covering the reinforcement in the support.

7. Point-supported element or flat concrete ceiling according to claim 1, wherein the flat concrete ceiling comprises prefabricated, adjacently arranged concrete slabs with a joint of predetermined width between adjacent concrete slabs, each concrete slab having a concrete top layer and, wherein an overhang of each upper concrete anchoring zone relative to each lower concrete anchoring zone of the same diagonal strut of the serpentine diagonal strut section and the diagonal strut closest to the support corresponds at least approximately to a distance of the edge of the concrete slab from a vertical projection of the support side face.

8. Point-supported element or flat concrete ceiling according to claim 7, wherein the overhang of the upper concrete anchoring zone corresponds at most to the distance of the edge of the concrete slab from the reinforcement in the support.

9. Point-supported element or flat concrete ceiling according to claim 7, wherein the overhang of the upper concrete anchoring zone corresponds at most to approximately half the half width of the joint between two adjacent concrete slabs.

10. Point-supported element or flat concrete ceiling according to claim 1, wherein in the lattice beam the upper bend portions are form loops which project upwardly beyond the upper chord or end at least approximately flush with a upper side of the upper chord.

11. A concrete ceiling point supported element comprising:

an upper chord extending longitudinally having a concrete anchoring zone end;

a plurality of parallel lower chords extending longitudinally and parallel to said upper chords;

a plurality of serpentine diagonal strut sections having first and second alternating diagonal struts, each of said plurality of serpentine diagonal strut sections having upper bent and lower bent portions, the upper bent portions of each of said plurality of serpentine diagonal strut sections being secured at securing points to said upper chord, and the lower bent portions of one of said plurality of serpentine diagonal struts being secured at securing points to one of said plurality of parallel lower chords, and the lower bent portions of another one of said plurality of serpentine diagonal struts being secured at securing points to another one of said plurality of parallel lower chords, whereby the first and second alternating diagonal struts extend successively between and transverse to said upper chord and said plurality of parallel lower chords;

wherein one of the first alternating diagonal struts adjacent to the concrete anchoring zone end of the lattice beam transverses said upper chords and said plurality of lower parallel chords at a first angle of between eighty-five degrees and seventy-five degrees angling towards the concrete anchoring zone end; and wherein the second alternating diagonal strut transverses said upper chord and said plurality of lower parallel chords at a second angle at least ten degrees less than the first angle and angles towards the concrete anchoring zone end.

12. A concrete ceiling point supported element for embedding in concrete having a lattice beam structure comprising:

an upper chord having a first diameter extending longitudinally and having a concrete anchoring zone end with an upper securing point;

a plurality of parallel lower chords having a diameter equal to the first diameter extending longitudinally and parallel to said upper chord, said plurality of parallel lower chords having a lower securing point, the upper securing point overhanging the lower securing point relative to a line extending perpendicularly through said upper chord and perpendicular to a plane formed by said plurality of parallel lower chords, whereby the upper securing point may be placed closer to a vertical support perpendicular to the lattice beam structure than the lower securing point;

a plurality of serpentine diagonal strut sections having first and second alternating diagonal struts, each of said plurality of serpentine diagonal strut sections having upper bent and lower bent portions, the upper bent portions of each of said plurality of serpentine diagonal strut sections extending beyond said upper chord and being secured to said upper chord in two different locations, and the lower bent portions of one of said plurality of serpentine diagonal struts being secured to one of said plurality of parallel lower chords, and the lower bent portions of another one of said plurality of serpentine diagonal struts being secured to another one of said plurality of parallel lower chords, whereby the first and second alternating diagonal struts extend successively between and transverse to said upper chord and said plurality of parallel lower chords, said plurality of serpentine diagonal strut sections having a second diameter, the second diameter being less than the first diameter of said upper chord and said plurality of parallel lower chords;

wherein one of the first alternating diagonal struts adjacent to the concrete anchoring zone end of the lattice beam transverses said upper chord and said plurality of lower parallel chords at a first angle of between eighty-five degrees and seventy-five degrees angled towards the concrete anchoring zone end; and wherein the second alternating diagonal strut transverses said upper chord and said plurality of lower parallel chords at a second angle at least ten degrees less than the first angle and angles towards the concrete anchoring zone end, whereby the upper securing point may be placed closer to a vertical support perpendicular to the lattice beam structure than the lower securing point assisting in preventing the propagation of cracks in a concrete ceiling.

* * * * *